US009113680B2

(12) United States Patent
Takazakura

(10) Patent No.: US 9,113,680 B2
(45) Date of Patent: Aug. 25, 2015

(54) BUCKLE

(75) Inventor: Ryoichiro Takazakura, Toyama (JP)

(73) Assignee: YKK Corporation (JP)

( * ) Notice: Subject to any disclaimer, the term of this patent is extended or adjusted under 35 U.S.C. 154(b) by 152 days.

(21) Appl. No.: 13/885,012

(22) PCT Filed: Nov. 15, 2010

(86) PCT No.: PCT/JP2010/070304

§ 371 (c)(1),
(2), (4) Date: May 13, 2013

(87) PCT Pub. No.: WO2012/066615

PCT Pub. Date: May 24, 2012

(65) Prior Publication Data

US 2013/0232743 A1 Sep. 12, 2013

(51) Int. Cl.
*A44B 11/25* (2006.01)
*A44B 11/26* (2006.01)

(52) U.S. Cl.
CPC ..... *A44B 11/266* (2013.01); *Y10T 24/45581* (2015.01)

(58) Field of Classification Search
CPC ..... A44B 11/2592; A44B 11/263; A44B 11/266; A44B 11/26; A44B 11/2519; A44B 11/2515
USPC ..... 24/615, 625, 651
See application file for complete search history.

(56) References Cited

U.S. PATENT DOCUMENTS 5,791,026 A 8/1998 Anscher
6,247,213 B1 6/2001 Uehara
6,421,889 B1 * 7/2002 Chien ..... 24/614
7,096,545 B2 * 8/2006 Uehara et al. ..... 24/614
2003/0014851 A1 1/2003 Murai et al.
2007/0204441 A1 9/2007 Saitsu

FOREIGN PATENT DOCUMENTS

CN 2901963 Y 5/2007
CN 102164519 A 8/2011

(Continued)

OTHER PUBLICATIONS

International Search Report, PCT Application No. PCT/JP2010/070304, mailed Feb. 15, 2011.

(Continued)

*Primary Examiner* — Jack W Lavinder
(74) *Attorney, Agent, or Firm* — Kilpatrick Townsend & Stockton LLP

(57) ABSTRACT

A buckle includes a pair of legs on a male member, and an engagement portion provided on an end of the legs that is to be engaged with an engaged portion of a female member in a form of a recessed groove, the engagement portion being detachably engaged with the engaged portion when the male member is inserted into the female member to a predetermined position. A guide for guiding the insertion of the male member provided between the legs of the male member. A hook-shaped movement restricting portion projecting in the direction for the pair of legs to face with each other is provided on an inner side of the legs. A deformation restricting portion projecting in a form of a flange toward the leg is provided to the guide. The movement restricting portion is in contact with the deformation restricting portion when the leg is outwardly deformed.

9 Claims, 16 Drawing Sheets

(56) References Cited

FOREIGN PATENT DOCUMENTS

| | | | |
|---|---|---|---|
| EP | 1400183 | A2 | 3/2004 |
| JP | 2000-106915 | A | 4/2000 |
| JP | 2003-33209 | A | 2/2003 |
| JP | 2004-160166 | A | 6/2004 |
| JP | 2007-229307 | A | 9/2007 |
| JP | 2009-11492 | A | 1/2009 |

OTHER PUBLICATIONS

Supplementary European Search Report, European Patent Application No. 10859789.9, mailed Aug. 21, 2014.

Office Action, Chinese Patent Application No. 201080070153.3, mailed Jan. 15, 2015.

* cited by examiner

BUCKLE

TECHNICAL FIELD

This application is a national stage application of PCT/JP2010/070304 which is incorporated herein by reference.

The present invention relates to a buckle having a male member and a female member. More specifically, the invention relates to a buckle used for connecting and separating both ends of a single string member or two string members with each other.

BACKGROUND ART

A buckle has been used as a means for connecting and separating both ends of a fastening string member (e.g. a single belt, tape or thread) or two string members with each other (see, for instance, Patent Literature 1).

Typical buckles include a plug and a socket into which the plug is inserted for engagement. The plug includes a plug body and a pair of legs provided in parallel with each other on both sides of the plug body. A manipulation portion and an engagement portion are provided on an end of each of the legs. The socket includes a socket body and an insertion hole provided in the socket body into which the plug is inserted. Abutment portions to be in contact with each of the legs to cause an inward elastic deformation of each of the legs are provided in the insertion hole. In addition, the insertion hole is provided with engaged portions with which the engagement portions of the legs are engaged and apertures for exposing the manipulation portions of the legs.

In this arrangement, in order for the plug to be engaged with the socket, the legs of the plug are inserted into the insertion hole of the socket. Then, the ends of the legs are inserted while being inwardly elastically deformed by the abutment portions of the socket. When the engagement portions of the legs go beyond the engaged portions provided to the socket, since the inwardly elastically deformed legs are elastically restored outward, the engagement portions of the legs are engaged with the engaged portions provided to the socket. In this state, the manipulation portions of the plug are exposed to an outer surface through the apertures of the socket.

In order to detach the plug from the socket, the manipulation portions of the plug exposed through the apertures of the socket are pressed mutually inward to inwardly elastically deform the legs. Then, the engagement portions of the legs are disengaged from the engaged portions provided to the socket. In this state, the plug is pulled out from the socket. Thus, the plug can be detached from the socket.

Incidentally, since the legs of the plug are deformable inwardly and outwardly in the above buckle, when, for instance, the leg(s) is excessively deformed outward by being caught in an external object, the leg(s) may be outwardly plastically deformed or may be eventually damaged if the leg(s) is forcibly further deformed toward an outside.

In order to remedy the above deficiencies, buckles disclosed in Patent Literatures 2 and 3 include a mechanism for restricting the pair of legs of the plug from deforming to be enlarged outward.

Specifically, Patent Literature 2 discloses a mechanism including a central member provided between a pair of legs (arm members) of the plug in parallel to the legs and curved holder straps (bent portions) connecting the central member and each of the arm members. Patent Literature 3 discloses a mechanism in which the pair of legs of the plug is connected by a curved holder strap (connection belt). According to the mechanisms disclosed in Patent Literatures 2 and 3, when the legs are enlarged outward, since the holder strap(s) is stretched to restrict the arm members from further outward expansion, the damage on the leg(s) can be avoided.

CITATION LIST

Patent Literature(s)

Patent Literature 1 JP-A-2004-160166
Patent Literature 2 JP-A-2007-229307
Patent Literature 3 JP-A-2009-11492

SUMMARY OF THE INVENTION

Problems(s) to be Solved by the Invention

However, the holder strap of the buckle disclosed in Patent Literature 2 is integrally molded with the same material as that of the plug and the holder strap is located at a position at which the arm member of the plug is the most eminently deformed, a load required for the operation for inserting the plug into the socket or the operation for detaching the plug from the socket increases. Similarly, the pair of legs of the buckle disclosed in Patent Literature 3 are connected at distal ends thereof, a load required for the operation for inserting the plug into the socket or the operation for detaching the plug from the socket increases.

In other words, when the plug is inserted into the socket or the plug is detached from the socket, it is necessary to inwardly elastically deform the arm member. However, the above typical buckles require that the holder strap is elastically deformed to be further deeply bent when the arm member is inwardly elastically deformed, which increases the load applied for the insertion/detachment operations.

An object of the invention is to provide a buckle capable of overcoming the above deficiencies and of exhibiting an excellent operability during engagement/detachment while avoiding a damage on a leg when the leg is outwardly deformed.

Means for Solving the Problem(s)

A buckle according to an aspect of the invention includes: a male member; and a female member into which the male member is inserted for engagement, the male member including: a male base to which a string member is attachable; a pair of legs projected from the male base, the pair of legs being capable of an elastic deformation in a direction orthogonal to an insertion direction of the male member; and an engagement portion respectively provided to each of the legs to be detachably engaged with the female member, the female member including: a female base to which a string member is attachable; an insertion hole provided in the female base into which the pair of legs are insertable while being elastically deformed in a direction for the legs to face with each other; a housing space provided in the female base in communication with the insertion hole, the pair of legs being housed within the housing space; and an engaged portion with which the engagement portions are engaged in a manner capable of detachment due to a restoration force of the pair of legs against the elastic deformation when the pair of legs are inserted to a predetermined position, in which the male member includes: a movement restricting portion provided to each of the legs, the movement restricting portion projecting in a direction to face with each other; and a deformation restricting portion provided on the male base in a manner being spaced apart from the movement restricting portion, the movement restricting portion being in contact with the deformation restricting portion to restrict the legs from deforming in a direction opposite to the direction for the legs to face with each other when one or both of the legs are deformed in the direction opposite to the direction for the legs to face with each other.

According to the above arrangement, when at least one of the legs of the male member is elastically deformed in the direction opposite to the direction for the legs to face with each other, at least one of the movement restricting portions respectively projecting in the direction for the legs to face with each other are in contact with at least one of the deformation restricting portions provided to the male base to restrict the leg(s) from deforming in the direction opposite to the direction for the legs to face with each other. Accordingly, even when an external force for deforming the leg(s) in the direction opposite to the direction for the legs to face with each other, the contact between the movement restricting portion(s) and the deformation restricting portion(s) keep the leg(s) from being damaged (e.g. breakage and a plastic deformation). Further, since the movement restricting portions and the deformation restricting portions are spaced apart (i.e. not connected), when the pair of legs are elastically deformed in the direction for the pair of legs to face with each other in inserting the male member into the female member for engagement, it is only necessary to elastically deform the legs. Accordingly, the operation force for engaging or detaching the male member and the female member can be minimized and an excellent operability during engagement or detachment process can be provided. In other words, the operability during the engagement operation or the detachment operation of the male member and the female member can be enhanced.

In the buckle according to the above aspect of the invention, it is preferable that the deformation restricting portions are directly provided to the male base.

According to the above arrangement, since the deformation restricting portion is directly provided to the male base, the structure can be simplified while minimizing the number of components.

In the buckle according to the above aspect of the invention, it is preferable that the male member includes a guide provided on the male base and projected from between the pair of legs, the female member comprises a guide portion with which the guide inserted through the insertion hole is in slidable contact to guide an insertion of the male member, and the deformation restricting portion is provided on the guide.

According to the above arrangement, with the use of the guide projecting between the pair of legs engaged with the guide portion to guide the insertion of the male member, the damage of the legs due to the deformation can be avoided even when an external force for deforming the leg(s) in the direction opposite to the direction for the legs to face with each other is applied. Further, since the deformation restricting portions are provided by using the structure for guiding the insertion of the male member, the guide and the deformation restricting portions can provided while sharing the same component and the structure can be simplified, thereby enhancing the productivity.

In the buckle according to the above aspect of the invention, it is preferable that the movement restricting portion is provided in an area of each of the legs between a center of a projection length and a base end of each of the legs near the male base.

According to the above arrangement, when the male member is inserted into or detached from the female member through the insertion hole, the movement restricting portion provided near the base end of the leg and the deformation restricting portion for the movement restricting portion to be in contact are unlikely to interfere with the other component. Accordingly, the movement restricting portion and the deformation restricting portion are kept from being in contact with other component to be damaged.

In the buckle according to the above aspect of the invention, it is preferable that the movement restricting portion includes an abutment surface facing one of the legs from which the movement restricting portion is projected, and the deformation restricting portion includes a restricting surface facing the abutment surface, the restricting surface being in contact with the abutment surface when the one of the legs from which the movement restricting portion is projected is deformed in a direction opposite to the direction for the pair of legs to face with each other.

According to the above arrangement, with a simple arrangement in which the abutment surface of each of the movement restricting portions faces the restricting surface of each of the deformation restricting portion, the abutment surface and the restricting surface are in contact with each other when the legs are deformed in the direction opposite to the direction for the legs to face with each other, thereby preventing the further deformation of the legs. Thus, the productivity can be easily enhanced with a simple structure.

A buckle according to another aspect of the invention includes: a male member; and a female member into which the male member is inserted for engagement, the male member including: a male base to which a string member is attachable; a pair of legs projected from the male base, the pair of legs being capable of elastic deformation in a direction orthogonal to an insertion direction of the male member; and an engagement portion provided to each of the legs to be detachably engaged with the female member, the female member including: a female base to which a string member is attachable; an insertion hole provided in the female base into which the pair of legs are insertable while being elastically deformed in a direction for the legs to face with each other; a housing space provided in the female base in communication with the insertion hole, the pair of legs being housed within the housing space; and an engaged portion with which the engagement portion is engaged in a manner capable of detachment due to a restoration force of the pair of legs against the elastic deformation when the pair of legs are inserted to a predetermined position, in which the male member includes: movement restricting portions provided to the legs, the movement restricting portions projecting in a direction for the legs to face with each other and being in contact with each other to restrict the legs from deforming in a direction opposite to the direction for the leg to face with each other when one or both of the legs is deformed in the direction opposite to the direction for the legs to face with each other.

According to the above arrangement, when at least one of the legs of the male member is elastically deformed in the direction opposite to the direction for the legs to face with each other, the movement restricting portions respectively projecting in the direction for the legs to face with each other are in contact with each other to restrict the legs from deforming in the direction opposite to the direction for the legs to face with each other. Accordingly, even when an external force for deforming the leg(s) in the direction opposite to the direction for the legs to face with each other is applied, the contact between the deformation restricting portions keeps the leg(s) from being damaged (e.g. breakage and a plastic deformation). Further, since the movement restricting portions each provided on the pair of legs (i.e. separate bodies) are spaced apart (i.e. not connected), when the pair of legs are elastically deformed in the direction for the pair of legs to face with each other in inserting the male member into the female member for engagement, it is only necessary to elastically deform the legs. Accordingly, the operation force for engaging or detaching the male member and the female member can be minimized and an excellent operability during engagement or detachment process can be provided. In other words, the operability during the engagement operation or the detachment operation of the male member and the female member can be enhanced.

In the buckle according to the above aspect of the invention, it is preferable that the movement restricting portions each include an abutment surface facing one of the legs from which each of the movement restricting portions is projected, the abutment surfaces face with each other so as to be adapted to be in contact with each other when one or both of the legs is deformed in the direction opposite to the direction for the legs to face with each other.

According to the above arrangement, with a simple arrangement in which the abutment surfaces of the movement restricting portions are opposed with each other, the abutment surfaces are in contact with each other when the legs are deformed in the direction opposite to the direction for the legs to face with each other, thereby preventing the further deformation of the legs. Thus, the productivity can be easily enhanced with a simple structure.

In the buckle according to the above aspect of the invention, the engagement portions are each provided on an outer surface of each of the legs opposite to a side for the pair of legs to face with each other.

According to the above arrangement, when the pair of legs are inserted to the insertion hole to the predetermined position and the legs are elastically restored, the convex engaged portions of the female member are engaged with the engagement portions of the legs in the form of the recessed grooves. Accordingly, the invention is applicable to a widely available so-called side-release side-engaging buckle in which the engagement portions and the engaged portions are engaged or detached when the male member and the female member are engaged or detached. Further, the engagement portion is provided on the outer face opposite to the side at which the legs are opposed with each other. Accordingly, the movement restricting portions for avoiding the damage on the leg are provided on the side of each of the legs facing the other of the legs. Accordingly, since the engagement portion and the movement restricting portion are not interfered, the invention is easily applicable to the widely available so-called side-release side-engaging buckle.

In the buckle according to the above aspect of the invention, it is preferable that the engagement portion is provided on an end of each of the legs and bulges to define a projection in a direction orthogonal to the direction for the legs to face with each other and orthogonal to the direction for the legs to be elastically deformed, and the engaged portion is provided in a recessed groove extending along a direction opposite to a direction for the pair of legs to be elastically restored against the elastic deformation when the pair of legs are inserted through the insertion hole to the predetermined position.

According to the above arrangement, when the pair of legs are inserted to the insertion hole to the predetermined position and the legs are elastically restored, the engaged portions of the female member in the form of the recessed grooves are engaged with the convex engagement portions of the legs. Accordingly, the invention is applicable to a widely available so-called side-release thickness-engaging buckle in which the engagement portion and the engaged portion are engaged or detached when the male member and the female member are engaged or detached. Further, the engagement portions are provided on the distal end of the legs and the movement restricting portions for avoiding the damage on the legs are provided at a point spaced apart from the engagement portions. Accordingly, since the engagement portions and the movement restricting portions are not interfered, the invention is easily applicable to the widely available so-called side-release thickness-engaging buckle.

BRIEF DESCRIPTION OF DRAWING(S)

DESCRIPTION OF EXEMPLARY EMBODIMENT(S)

First Exemplary Embodiment

A first exemplary embodiment of the invention will be described below with reference to the attached drawings.

Figure 1:
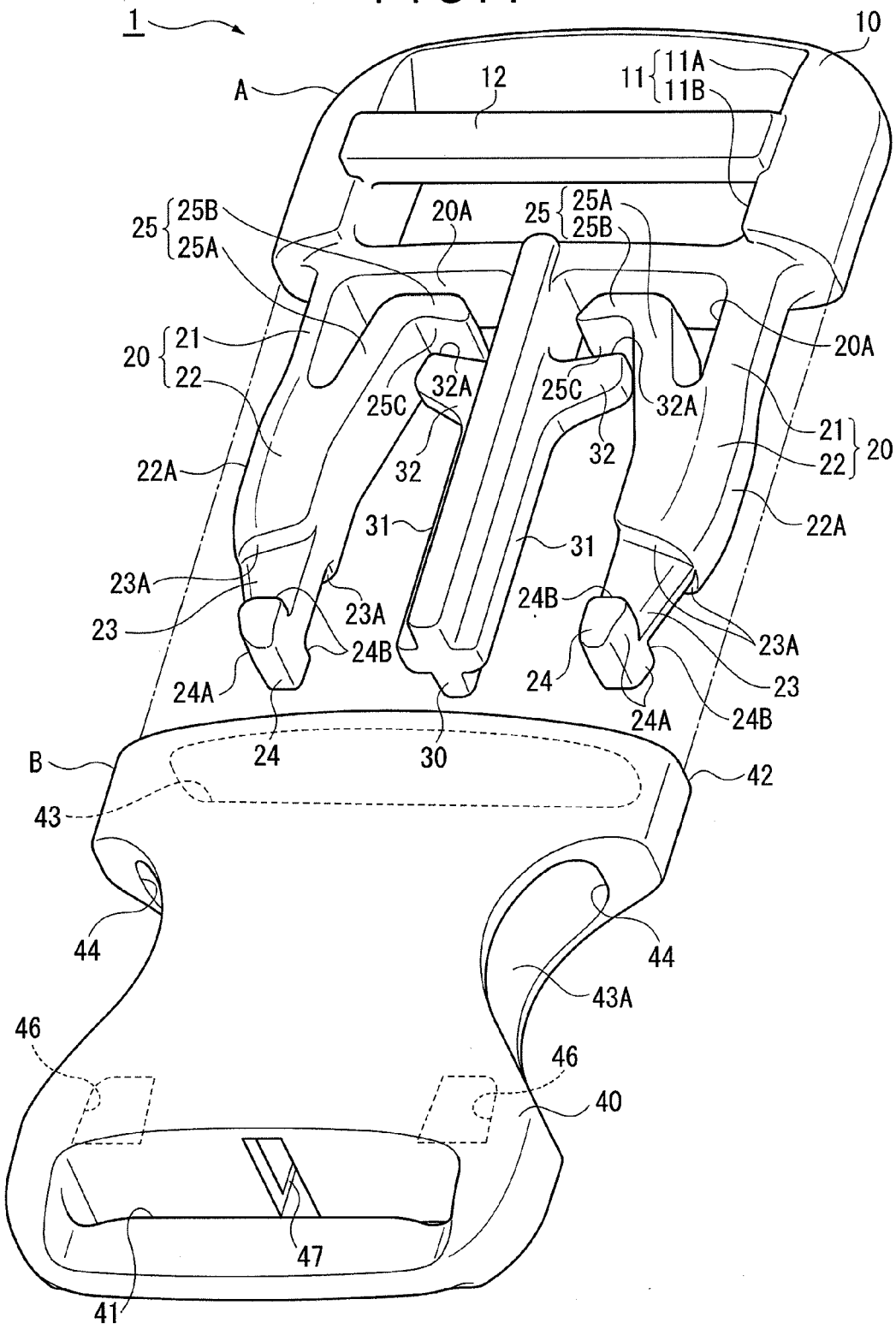
FIG. 1 is an exploded perspective view showing a buckle according to a first exemplary embodiment of the invention.
Figure 2:
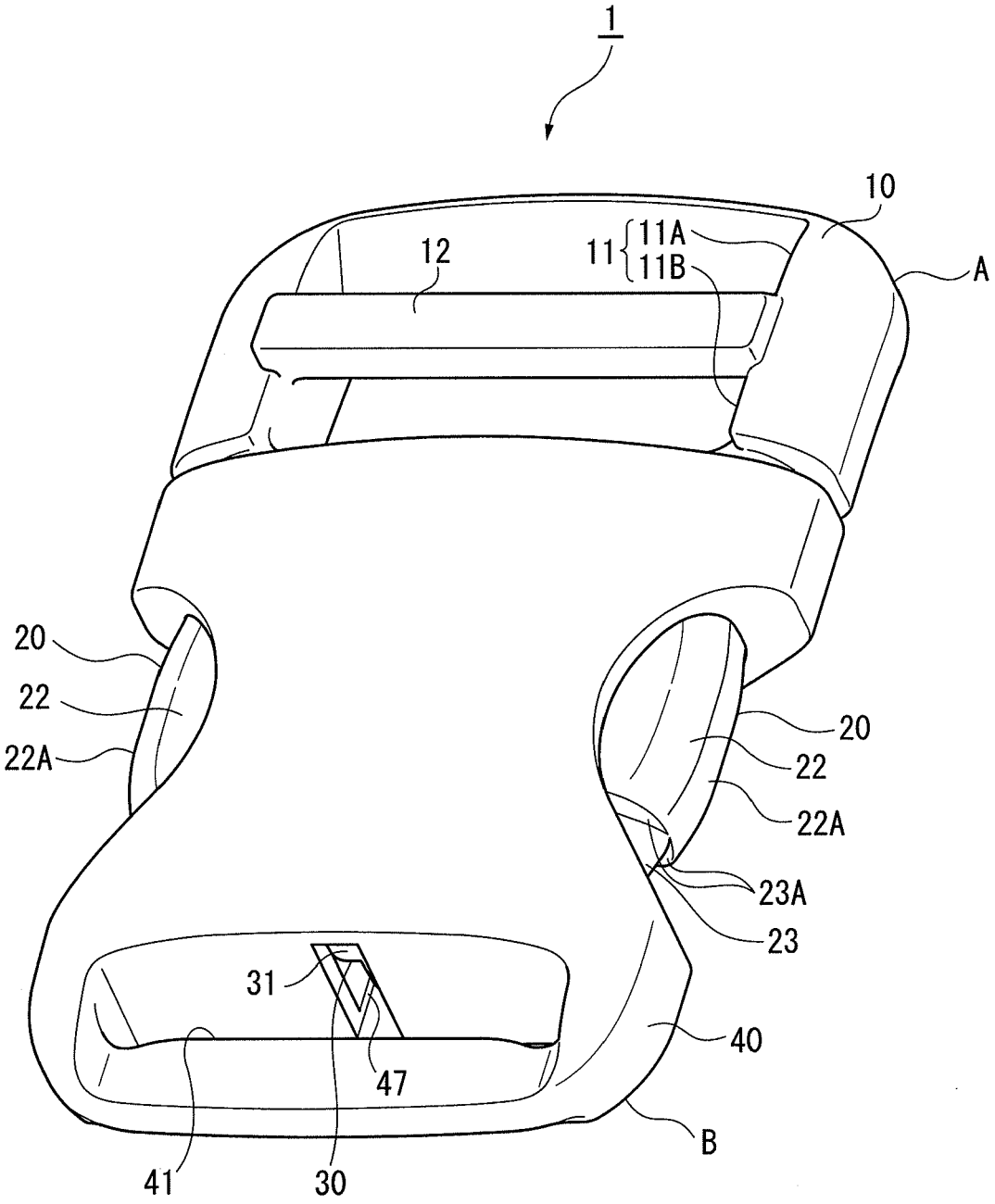
FIG. 2 is a perspective view showing an engagement state of the buckle according to the first exemplary embodiment.
Figure 3:
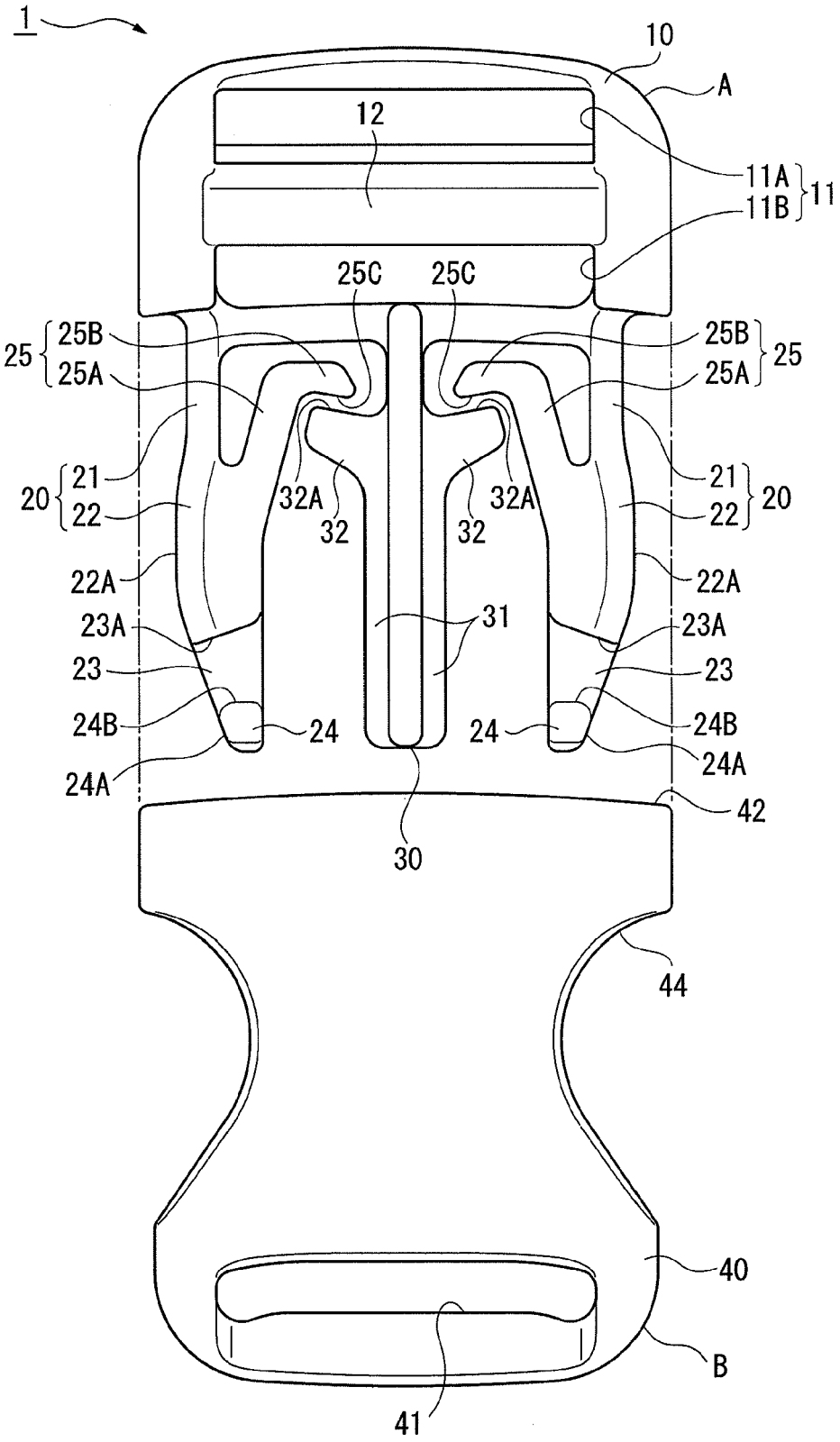
FIG. 3 is an exploded plan view showing the buckle according to the first exemplary embodiment.
Figure 4:
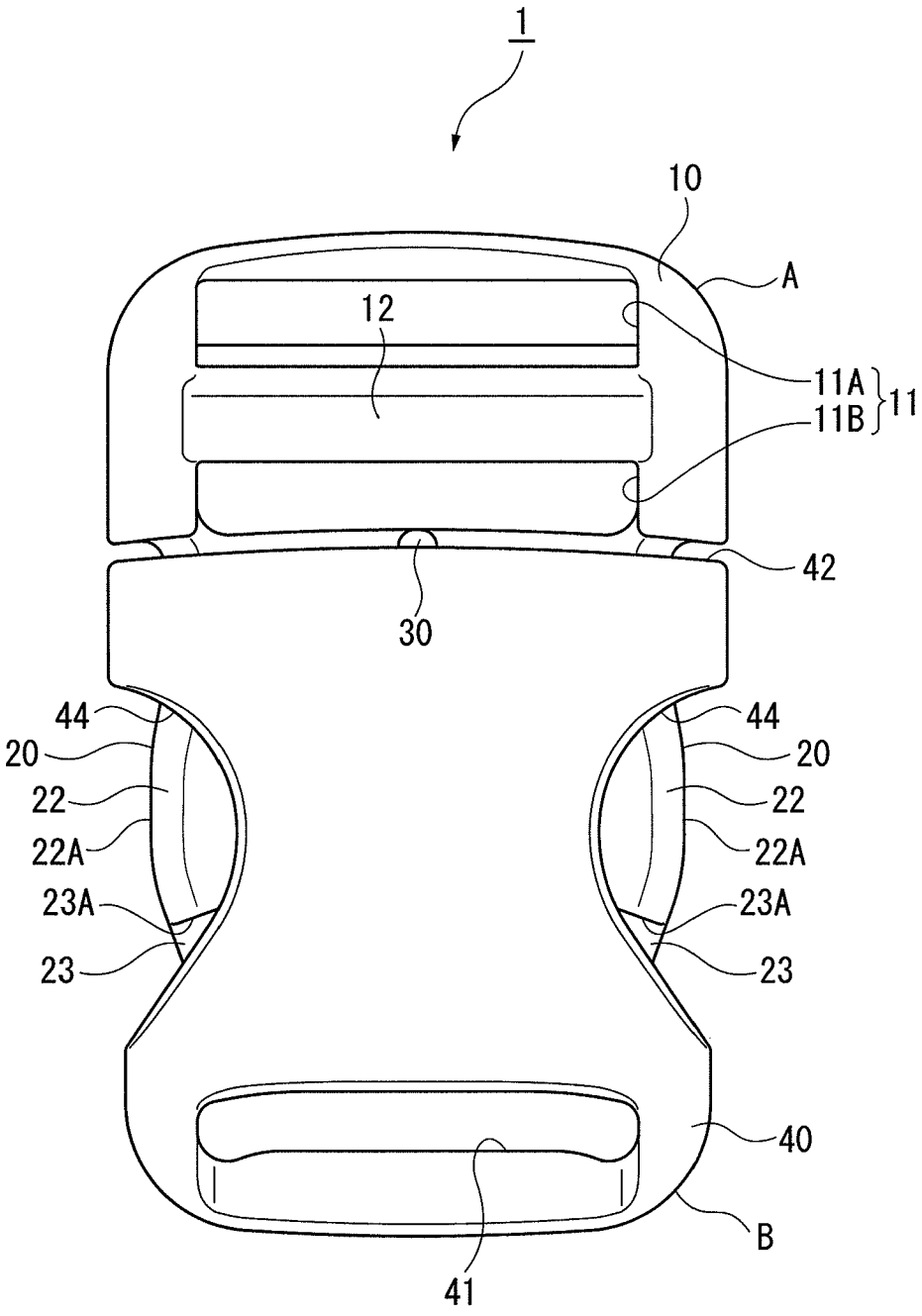
FIG. 4 is a plan view showing the buckle according to the first exemplary embodiment.

FIG. 1 is an exploded perspective view of a buckle according to a first exemplary embodiment. FIG. 2 is a perspective view showing an engagement state of the buckle according to the first exemplary embodiment. FIG. 3 is an exploded plan view of the buckle according to the first exemplary embodiment. FIG. 4 is a plan view showing the engagement state of the buckle according to the first exemplary embodiment. FIG.

5 is a partial cross section showing the engagement state of the buckle according to the first exemplary embodiment.

Structure of Buckle

A buckle 1 according to the first exemplary embodiment is used for connecting and separating both ends of a fastening string member (e.g. a belt, a tape or a thread) or two string members with each other.

Figure 5:
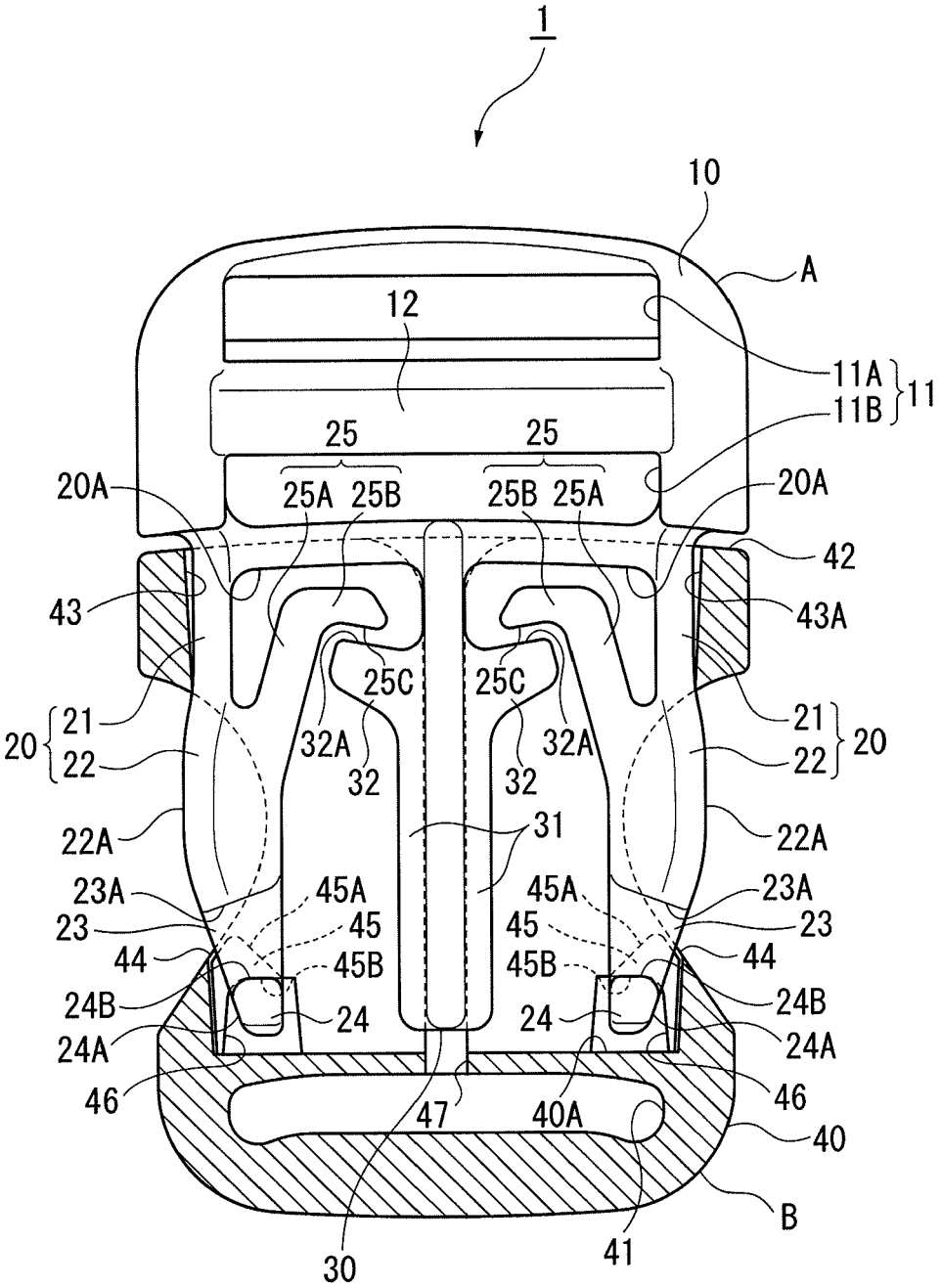
FIG. 5 is a partial cross section showing the engagement state of the buckle according to the first exemplary embodiment.

The buckle 1 is a so-called side-release buckle to be engaged in a thickness direction thereof (i.e. depth direction in FIGS. 3 to 5). The buckle 1 includes a male member A integrally molded with a synthetic resin and a female member B into which the male member A is inserted for engagement, the female member B being similarly integrally molded with a synthetic resin.

It should be noted that the material of the male member A and the female member B is not limited to a synthetic resin but may alternatively be other material such as metal. Further, the male member A and the female member B may be made of different materials (e.g. partially using synthetic resin and metal).

The male member A includes a male base 10, a pair of legs 20 projected from the male base 10 and a guide 30 projected from the male base 10.

The male base 10 is provided with a string attachment hole 11 (string attachment) at an inner central portion thereof for an end of the string member to be inserted and held. A connecting bar 12 is provided in the middle of the string attachment hole 11. The connecting bar 12 divides the string attachment hole 11 into two string attachment holes 11A and 11B, thereby allowing a length adjustment of the string member.

A pair of legs 20 project in parallel with each other from both sides of the male base 10 in a width direction (i.e. a direction orthogonal to the insertion direction of the male member A: right-left direction in FIGS. 3 to 5). In addition, a single guide 30 projects in parallel to the pair of legs 20 from the male base 10 at a position between the pair of legs 20.

Each of the legs 20 is elastically deformable in a direction intersecting the insertion direction of the male member A (specifically, in the width direction of the male base 10). Each of the legs 20 includes a leg base 21 integrally projected from the male base 10 in the insertion direction (i.e. a length direction of the male member A), and a leg manipulation portion 22 extending from an end of the leg base 21 in the insertion direction of the male member A to be enlarged in the width direction of the male member A. An outer side surface 22A of the leg manipulation portion 22 of the leg 20 that bulges to an outside (i.e. a side opposite to a side for each of the pair of legs 20 to face with each other) is biased to an inside (i.e. in a direction for the pair of legs 20 to face with each other) to cause an inward elastic deformation of the leg base 21.

A recessed groove-shaped engagement recess 23A extending along a width direction of the legs 20 (i.e. a direction for the legs 20 to be elastically deformed) is provided at the end of the each of legs 20 in a thickness direction of the buckle 1 (i.e. a direction orthogonal to the insertion direction of the male member 10 and orthogonal to the direction for the legs to be elastically deformed) on each side thereof, thereby defining an engagement piece 23 that is thinner than a thickness of the leg manipulation portion 22.

Further, an engagement portion 24 that bulges in the thickness direction of the buckle 1 to be thicker than the thickness of the engagement piece 23 is provided at the end of each of the legs 20 at a further distal end of the engagement piece 23. The engagement portions 24 are each provided with an engagement guide surface 24A on a side facing the outside in the width direction, the engagement guide surface 24A being slanted inward toward the direction for each of the legs 20 to be projected. The engagement portion 24 is further provided with engaging surfaces 24B that face the engagement recesses 23A and are parallel to the width direction.

A movement restricting portion 25 projecting in the direction for the pair of legs 20 to face with each other is provided on an inner side surface of each of the legs 20. The movement restricting portion 25 includes a branch portion 25A having an end projecting from an inner side surface of the leg manipulation portion 22 toward the male base 10 and a restriction hook portion 25B defined by bending the end of the branch portion 25A in a hook shape in the direction for the legs 20 to face with each other. Thus, the movement restricting portion 25 is provided in a hook shape. An inner surface of the restriction hook portion 25B, i.e. the surface facing the end of the legs 20, defines an abutment surface 25C.

A base end (i.e. an end opposite to the distal end) of the movement restricting portion 25 is located in an area between a half of the length of each of the legs 20 to the male base 10, in other words, near a base end of the leg 20 relative to the center of the longitudinal length of each of the legs 20. The movement restricting portion 25 is shaped to be not in contact with the male base 10 when the legs 20 are inwardly elastically deformed to be engaged with the female member B. This is because, when the movement restricting portion 25 is in contact with the male base 10 before the legs are engaged with the female member B, the legs 20 are restricted from being further inwardly elastically deformed, so that the legs 20 may not be engaged with the female member B.

The guide 30 projects in parallel to the pair of legs from the center of the male base 10 in the width direction between the pair of legs 20.

The guide 30 is provided with reinforcing ribs 31 that are each provided in a longitudinal rib shape on side surfaces facing each of the legs 20, the reinforcing ribs 31 extending from the distal end of the guide 30 to the proximity of the male base 10.

The guide 30 is provided with deformation restricting portions 32 continuous with a part of the reinforcing ribs 31 near the male base 10 to project in a form of a "flange" toward each of the legs 20. An end of each of the deformation restricting portions 32 projects toward an area between each of the branch portions 25A and each of the restriction hook portions 25B of the movement restricting portions 25. Specifically, the movement restricting portion 25 of each of the legs 20 is designed so that the restriction hook portion 25B is located in a space 20A surrounded by each of the legs 20, the male base 10, the guide 30 and each of the deformation restricting portions 32 for allowing the elastic deformation of the legs 20.

Each of the deformation restricting portions 32 has a restricting surface 32A that faces the abutment surface 25C of each of the movement restricting portions 25 and contacts each of the movement restricting portions 25 when the leg(s) 20 is outwardly deformed by an external force.

The female member B includes a flat tubular female member body 40 (female base).

The female base body 40 is provided with a string attachment hole 41 for an end of the string member to be inserted and held.

Figure 6:
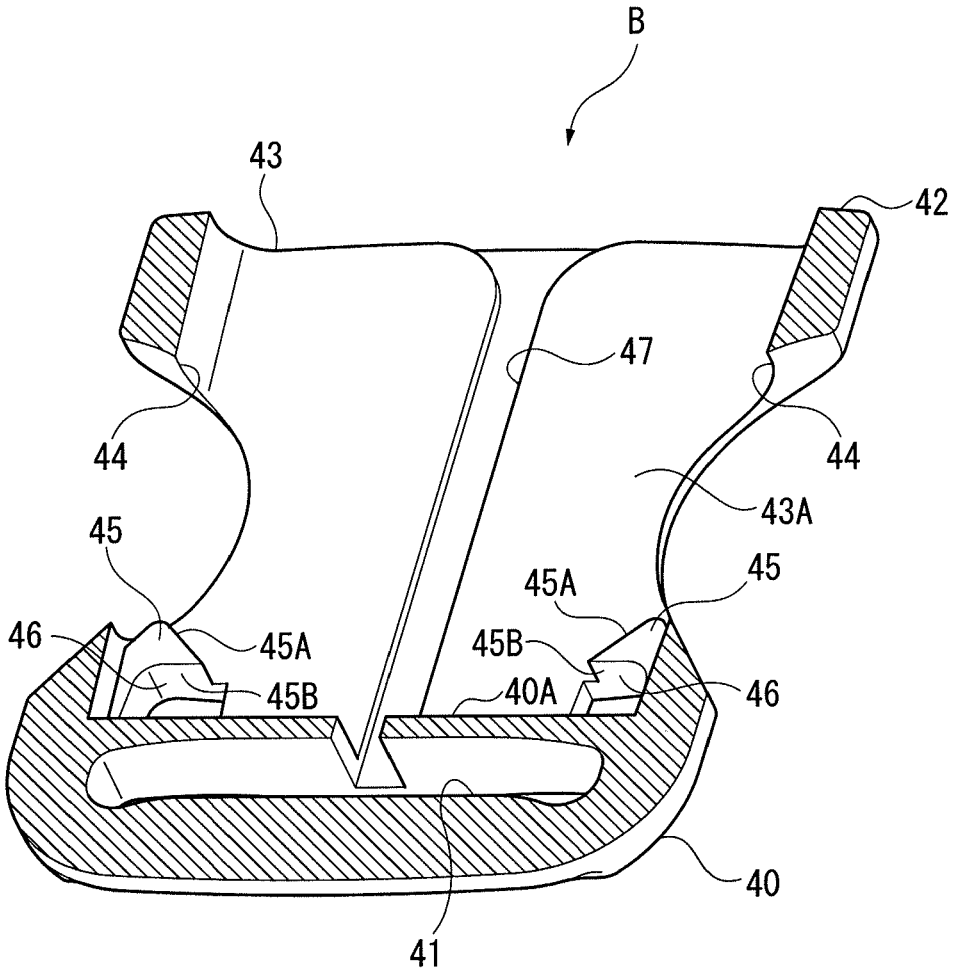
FIG. 6 is a cross-sectional perspective view showing a female member according to the first exemplary embodiment.

As shown in FIGS. 5 and 6, the female member body 40 is provided with an insertion hole 43 penetrated from an attachment surface 42 with the male member A to the string attachment hole 41 for receiving the legs 20 and the guide 30 of the male member A. The female member body 40 includes a housing space 43A continuous with the insertion hole 43 to be capable of housing the pair of legs 20 of the male member A. The female member body 40 is provided in a flat tubular shape.

Apertures 44 that are cut in an arc-like recess enlarged toward the center of the female member body 40 to expose the leg manipulation portions 22 of the male member A toward an outside are formed on both lateral walls in the width direction of the female member body 40.

The female member body 40 is provided with a pair of engaging portions 45 located at a depth side in the housing space 43A relative to a part of the apertures 44 corresponding to the end of the male member A in the insertion direction. The pair of engaging portions 45 project in the housing space 43A to face with each other and are adapted to enter into the engagement recesses 23A of the legs 20 to hold the engagement portions 24.

Each of the engaging portions 45 includes an engagement guide surface 45A slanted toward the center of the housing space 43A from the insertion hole 43 to the depth side of the housing space 43A. The engagement guide surface 24A of the engagement portion 24 of each of the inserted legs 20 is in contact with the engagement guide surface 45A. Each of the engaging portions 45 further includes a detachment prevention face 45B that is substantially parallel to a depth wall of the housing space 43A. The engaging surface 24B of each of the engagement portions 24 facing the engagement recess 23A is in contact with the detachment prevention face 45B so that the engagement portion 24 of each of the legs 20 is engaged thereat. An engaged portion 46 in a form of a recessed groove that is opened at least inward in the width direction is defined between the detachment prevention face 45B of each of the engaging portions 45 and the inner end face 40A of the female member body 40, so that the engagement portion 24 of each of the legs 20 is capable of being engaged therewith or disengaged therefrom.

The female member body 40 is provided with a guide groove 47 (guide portion) in a form of a recessed groove extending from the center of an opening periphery of the insertion hole 43 along the insertion direction of the male member A. The guide 30 of the male member A is slidably fitted into the guide groove 47. A part of the guide groove 47 near the opening periphery of the insertion hole 43 is gradually widened so that the guide 30 can be introduced into the guide groove 47 even when the guide 30 is misaligned when being inserted into the guide groove 47.

Insertion/Engagement Operation of Buckle

Next, an insertion/engagement operation of the buckle 1 according to the above first exemplary embodiment will be described below.

When the male member A is to be engaged with the female member B, the legs 20 of the male member A are inserted into the insertion hole 43 of the female member B. During the insertion, the guide 30 of the male member A is fitted into the guide groove 47 of the female member B to guide the insertion operation.

As the insertion operation progresses, the engagement guide surfaces 24A of the engagement portions 24 provided at the end of the legs 20 are in contact with the engagement guide surfaces 45A of the engaging portions 45 of the female member B, whereby the legs 20 are further inserted while being elastically deformed inwardly in the direction substantially orthogonal to the insertion direction.

The inward elastic deformation of the legs 20 is effected by an elastic deformation of the leg base 21 (a widthwise thin portion) about the base end thereof to be flexed inward, so that the leg manipulation portion 22 is inwardly inclined. Due to the elastic deformation of the legs 20, the ends of the movement restricting portions 25 are moved away from the deformation restricting portion 32 toward the male base 10. Incidentally, each of the movement restricting portions 25 is designed so as not to be in contact with the male base 10.

When the legs 20 are further inserted, the engagement portions 24 go beyond the engaging portions 45. Then, the legs 20 are elastically restored to an original state, i.e. outward, by virtue of a restoration force of the legs 20 against the elastic deformation. The elastic restoration of the legs 20 causes the engaging portions 45 to enter into the engagement recesses 23A, whereby the engagement portions 24 are engaged with the engaged portion 46.

As described above, when the male member A and the female member B are to be engaged, only an operation force for causing the inward elastic deformation of the pair of legs 20 is necessary. In other words, the male and female members can be engaged with a minimum operation force without elastically deforming other components.

Disengagement Operation of Buckle

Next, a disengagement operation of the buckle 1 according to the above first exemplary embodiment will be described below.

In order to release the engagement between the male member A and the female member B for detachment, the pair of legs 20 exposed to an outside through the apertures 44 of the female member B are pinched in the width direction to cause an inward elastic deformation.

Then, while each of the engagement portions 24 of the legs 20 is detached from each of the engaged portions 46 to go beyond the engaging portion 45, the male member A is operated to be drawn out from the insertion hole 43 of the female member B, thereby detaching the male member A from the female member B. It should be noted that each of the movement restricting portions 25 is also not in contact with the male base 10 when the engagement portions 24 are detached from the engaged portions 46.

As described above, when the male member A and the female member B are detached, only an operation force for causing the inward elastic deformation of the pair of legs 20 is necessary, thereby allowing a detachment operation with a minimum operation force.

Application of External Force on Leg

Next, a situation occurred when an external force directed toward an outside is applied on the leg(s) 20 of the buckle 1 according to the above-described first exemplary embodiment will be described below.

For instance, when a string or the like is caught on the leg(s) 20 and the external force for outwardly widening the gap between ends of the legs 20 in the width direction of the buckle 1 is applied, the leg(s) 20 is outwardly elastically deformed. The elastic deformation is effected by the elastic deformation of the leg base 21 (a widthwise thin portion) about the base end thereof to be flexed outward. Due to the elastic deformation of the leg(s) 20, the end of the movement restricting portion 25 is moved toward the deformation restricting portion 32 to be in contact therewith.

Thus, when the external force for further outwardly deforming the leg 20 is applied, since the movement restricting portion 25 is in contact with the deformation restricting portion 32, the leg 20 is kept from being outwardly deformed. Accordingly, even when the external force for outwardly deforming the leg 20 is applied, damage (e.g. breakage and plastic deformation) is not caused on the leg 20.

Advantage(s) of First Exemplary Embodiment

As described above, according to the first exemplary embodiment, even when an external force for outwardly deforming the leg(s) 20 is applied, the movement restricting portion 25 inwardly projected from the leg(s) 20 is in contact with the deformation restricting portion 32 of the male member A to prevent further deformation, so that the leg(s) 20 is kept from being damaged. Further, when the male member A is engaged with the female member B, since the movement restricting portion 25 and the deformation restricting portion 32 are not connected, only an operation force for causing the inward elastic deformation of the leg(s) 20 is necessary, thereby allowing an insertion/engagement and detachment operations of the male member A and the female member B with a minimum operation force.

Thus, both an excellent operability and damage prevention of the legs 20 can be provided during the engagement operation or the detachment operation of the male member A and the female member B.

In the above-described first exemplary embodiment, in the arrangement in which the guide 30 projected from between the pair of legs 20 is engaged with the guide groove 47 for guiding the insertion of the male member A, the movement restricting portion(s) 25 is in contact with the deformation restricting portion(s) 32 provided to the guide 30 to prevent the damage on the leg(s) 20 when an external force for outwardly deforming the leg(s) 20 is applied.

Thus, since the deformation restricting portion 32 is provided by using the structure for guiding the insertion of the male member A, the guide 30 and the deformation restricting portions 32 can be provided sharing the same component and the structure can be simplified, thereby enhancing the productivity.

Further, in the above-described first exemplary embodiment, when the male member A is inserted into or detached from the female member B through the insertion hole 43, the movement restricting portions 25 provided near the base ends of the legs 20 and the deformation restricting portions 32 provided on the male base 10 to be in contact with or apart from the movement restricting portions 25 are unlikely to interfere with the other component.

Accordingly, the movement restricting portions 25 and the deformation restricting portions 32 are kept from being in contact with other component to be damaged. In addition, a failure in the elastic deformation of the legs 20 caused by a contact of the movement restricting portion(s) 25 with the other component(s) when the legs 20 are elastically deformed for insertion/engagement and detachment of the male member A and the female member B can be prevented with a simple structure in which the movement restricting portions 25 are provided at the base ends of the legs 20.

Especially, the movement restricting portions 25 in the above-described first exemplary embodiment are shaped to be not in contact with the male base 10 when the legs 20 are inwardly elastically deformed to be engaged with the female member B. Specifically, the movement restricting portion 25 is designed so that the restriction hook portion 25B of the movement restricting portion 25 is located in the space 20A of the male member A without being in contact with the other components. Thus, the inward elastic deformation of the legs 20 is not restricted during the insertion/engagement and detachment operations, so that the legs 20 can be elastically deformed with a minimum operation force, thereby enhancing the operability.

Further, in the above first exemplary embodiment, with a simple arrangement in which the abutment surfaces 25C of the movement restricting portions 25 is located to face the restricting surfaces 32A of the deformation restricting portions 32, the abutment surfaces 25C and the restricting surfaces 32A are in contact with each other when the legs 20 are deformed in a direction opposite to a direction in which the legs 20 face with each other, thereby preventing the further deformation of the legs 20.

Specifically, each of the movement restricting portions 25 is provided in a hook shape with the abutment surface 25C facing the end of each of the legs 20. While facing the abutment surfaces 25C of the movement restricting portions 25, the restricting surfaces 32A of the deformation restricting portions 32 are located ahead a movement path of the abutment surfaces 25C when the legs 20 are outwardly deformed.

Thus, the productivity can be easily enhanced with a simple structure.

Further, the buckle 1 of the above-described first exemplary embodiment relates to a so-called side-release buckle in which, when the pair of legs 20 are inserted into the insertion hole 43 up to a predetermined position and the legs 20 are elastically restored, the projected engagement portions 24 of the legs 20 are engaged (in the thickness direction) with the engaged portions 46 in the form of recessed grooves of female member B.

Specifically, the movement restricting portion 25 for preventing the damage on the legs 20 is spaced apart from the engagement portion 24 provided at the end of each of the legs 20. Thus, since the engagement portions 24 are not interfered with the movement restricting portion 25, a mechanism capable of preventing a damage on the legs 20 while ensuring excellent operability can be easily applied on the widely available so-called side-release thickness-direction-engaging buckle 1.

Modification(s)

It should be noted that the invention is not limited to the above arrangements of the first exemplary embodiment but encompasses the following modifications.

Second Exemplary Embodiment

Figure 7:
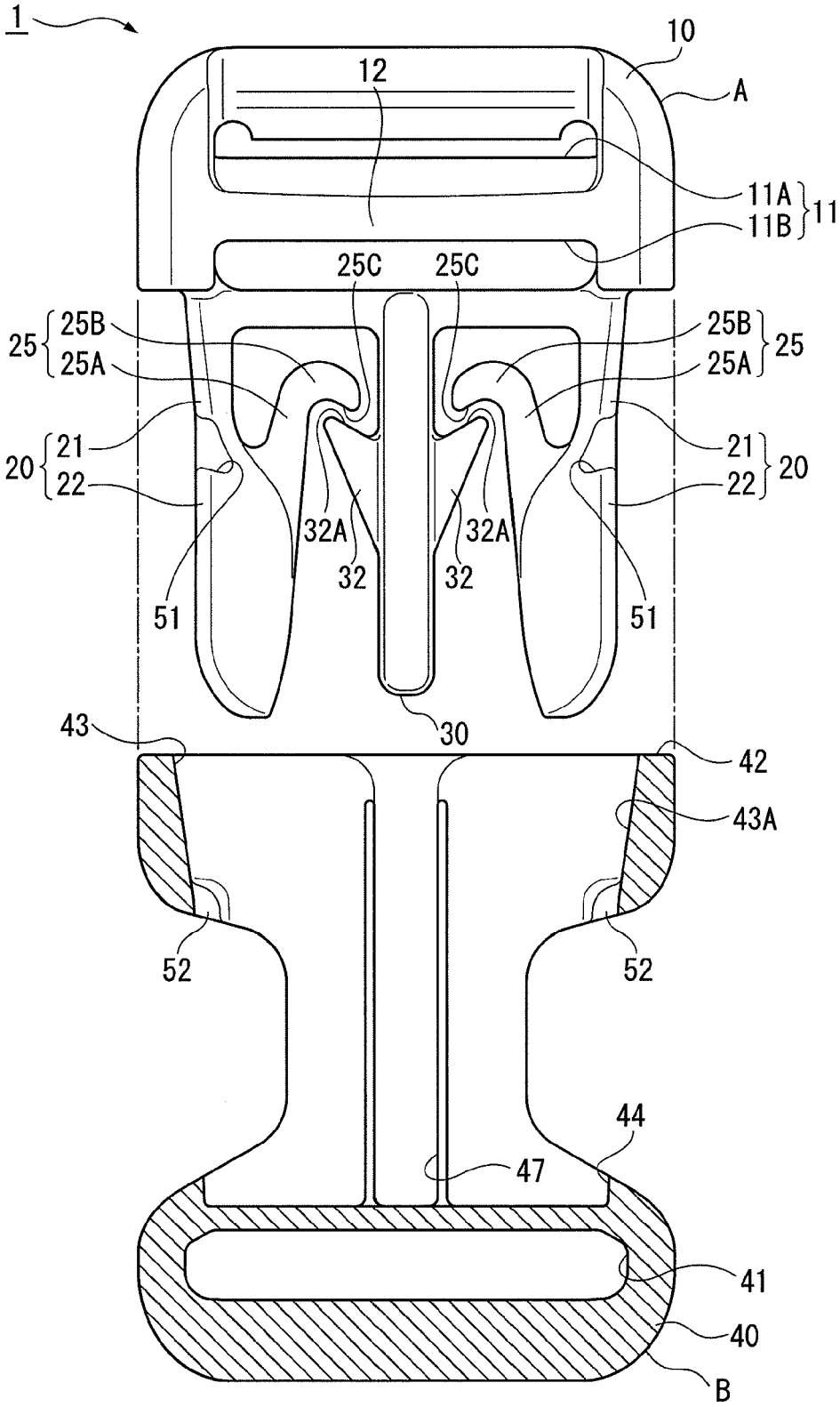
FIG. 7 is an exploded plan view showing a buckle according to a second exemplary embodiment of the invention with a part of the buckle being removed.
Figure 8:
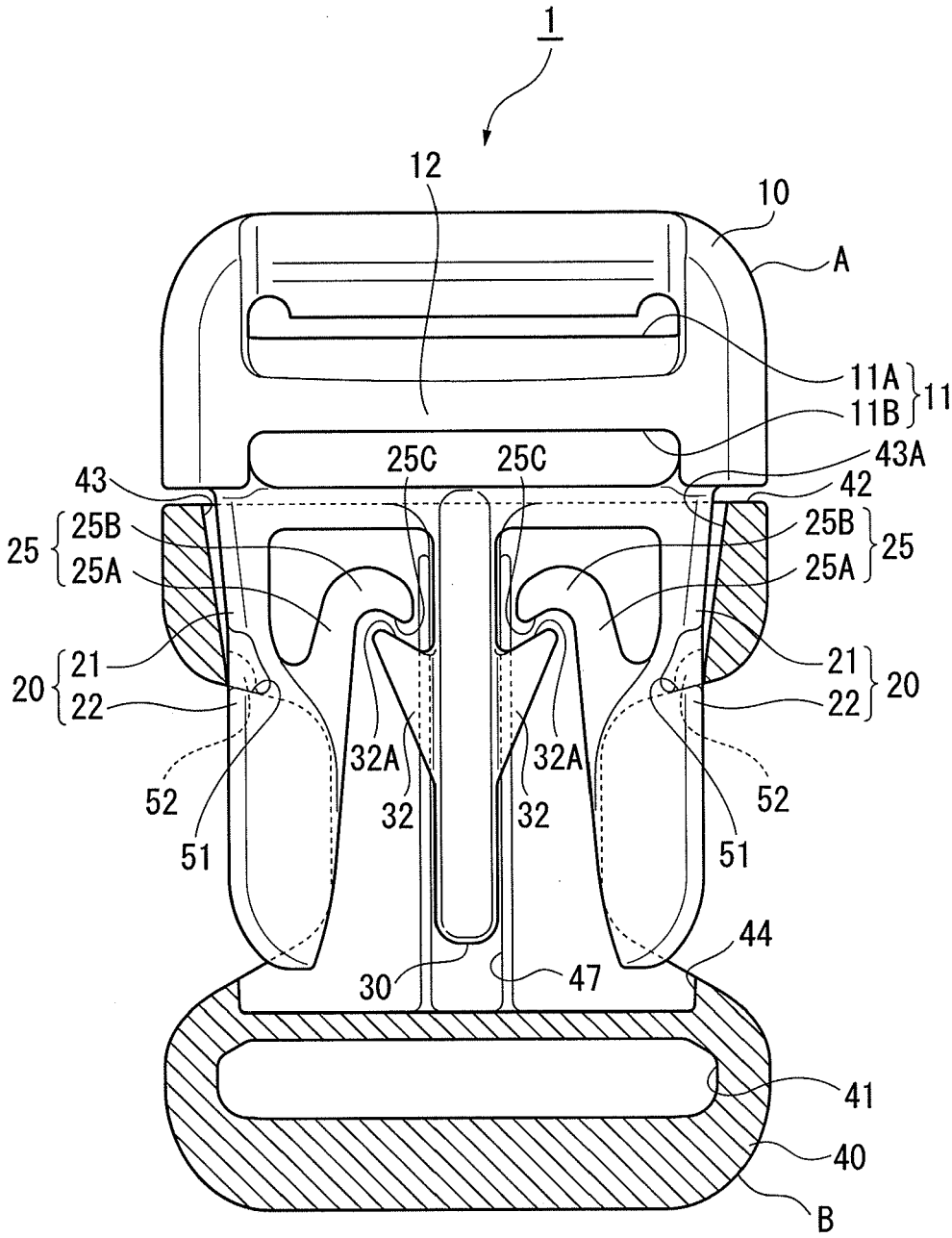
FIG. 8 is a partial cross section showing an engagement state of the buckle according to the second exemplary embodiment.
Figure 9:
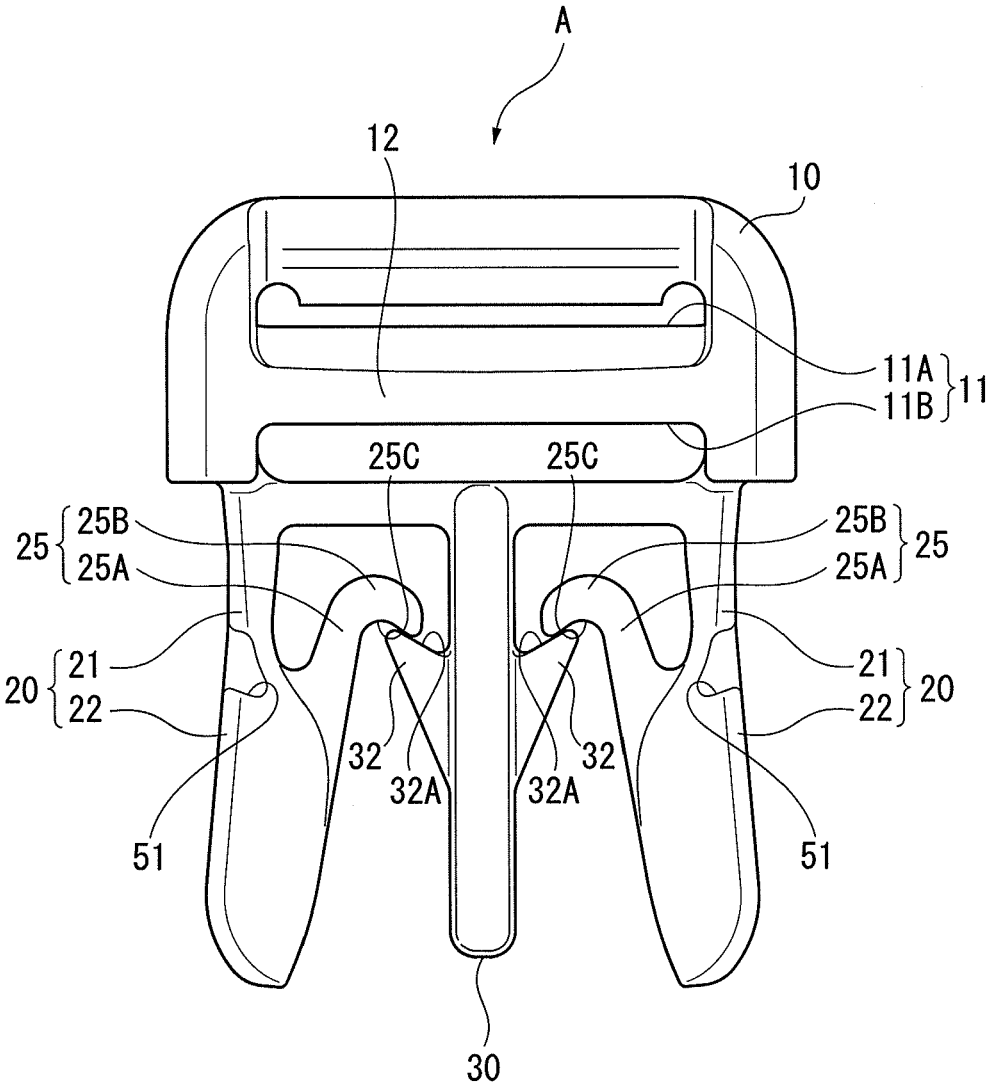
FIG. 9 is a plan view showing a male member according to the second exemplary embodiment with a gap between legs thereof being enlarged.

Though the invention is applied to the so-called side-release thickness-direction-engaging buckle 1 in the first exemplary embodiment, the invention is applicable to a side-engaging buckle 1 according to a second exemplary embodiment as shown in FIGS. 7 to 9. It should be noted that the same reference numeral will be attached to the same or corresponding components as those in the first exemplary embodiment shown in FIGS. 1 to 6 to omit or simplify the description thereof.

Specifically, in the second exemplary embodiment shown in FIGS. 7 and 8, an engagement portion in the form of an engaging recess 51 opened outward from one side in the thickness direction of each of the legs 20 is provided on each sides in the thickness direction of each of the legs 20 between the leg base 21 and the leg manipulation portion 22.

On the other hand, at the opening periphery of each of the apertures 44, the female member B is provided with an engaged portion in the form of stopper projections 52 to be detachably engaged with the engaging recesses 51.

When the legs 20 of the male member A are inserted into the insertion hole 43 of the female member B, the end of each of the legs 20 is in contact with each of the stopper projections 52 of the female member B to cause an inward elastic deformation of each of the legs 20. Then, when the engaging recesses 51 of the legs 20 reach the stopper projections 52 of the female member B, the legs 20 are elastically restored to bring the stopper projections 52 into engagement with the engaging recesses 51, thereby connecting the male member A with the female member B.

According to the second exemplary embodiment shown in FIGS. 7 and 8, even when the legs 20 are outwardly deformed as shown in FIG. 9, the movement restricting portions 25 of the legs 20 are in contact with each of the deformation restricting portions 32 of the guide 30 to prevent the damage on the legs 20.

Further, the movement restricting portions 25 and the deformation restricting portions 32 may be designed in any manner as long as the movement restricting portions 25 and the deformation restricting portions 32 are in contact with each other to prevent a breakage and plastic deformation of the legs 20 when an external force for outwardly deforming the legs 20 is applied to cause the deformation of the legs 20.

Third Exemplary Embodiment

Figure 10:
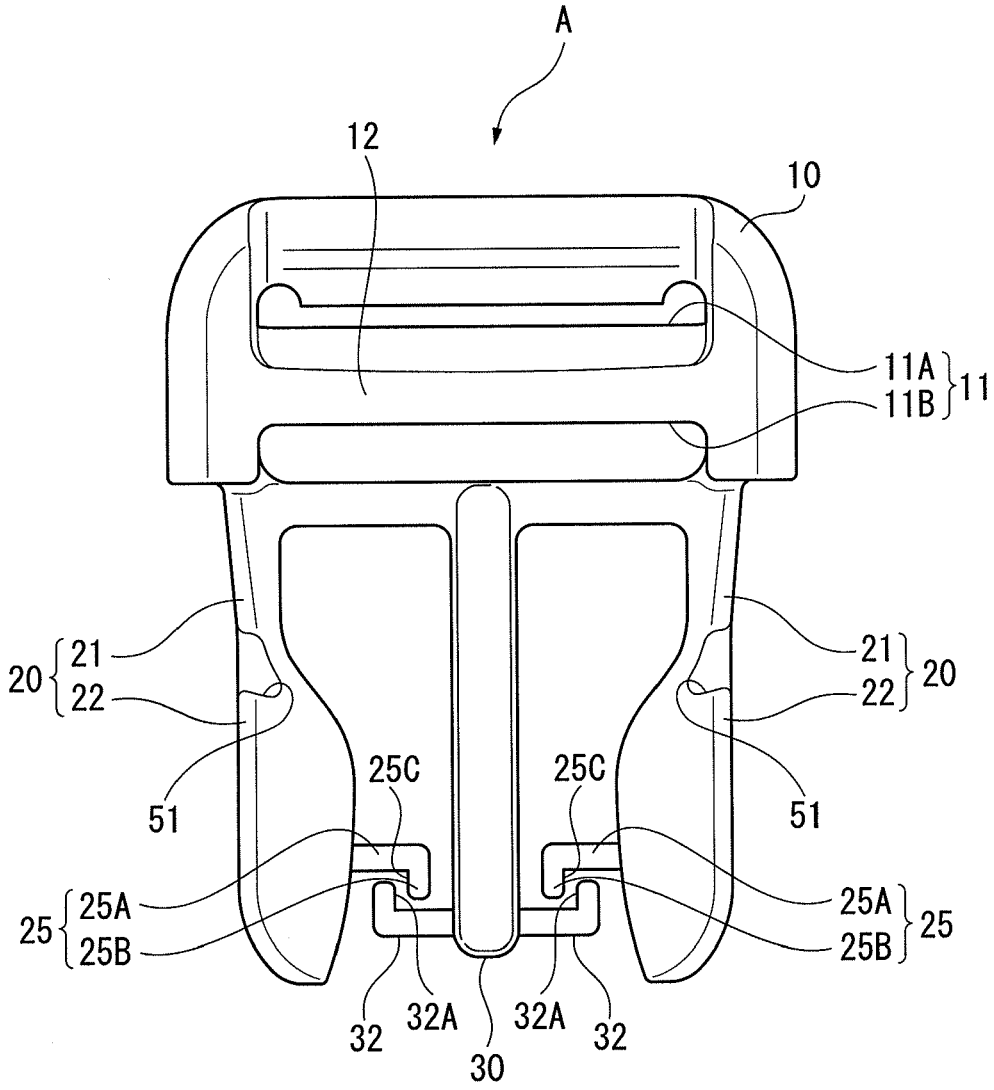
FIG. 10 is a plan view showing a male member of a buckle according to a third exemplary embodiment of the invention.

For instance, though the movement restricting portions 25 are provided near the base end of the guide in the second exemplary embodiment shown in FIGS. 7 to 9, the movement restricting portions 25 may be provided near a distal end of the guide 30 as in a third exemplary embodiment shown in FIG. 10. Further, the shape of the movement restricting portions 25 and the deformation restricting portions 32 may be respectively provided in similar hook shapes as shown in FIG. 10 to be in contact with or separated away from each other.

Fourth Exemplary Embodiment

Figure 11:
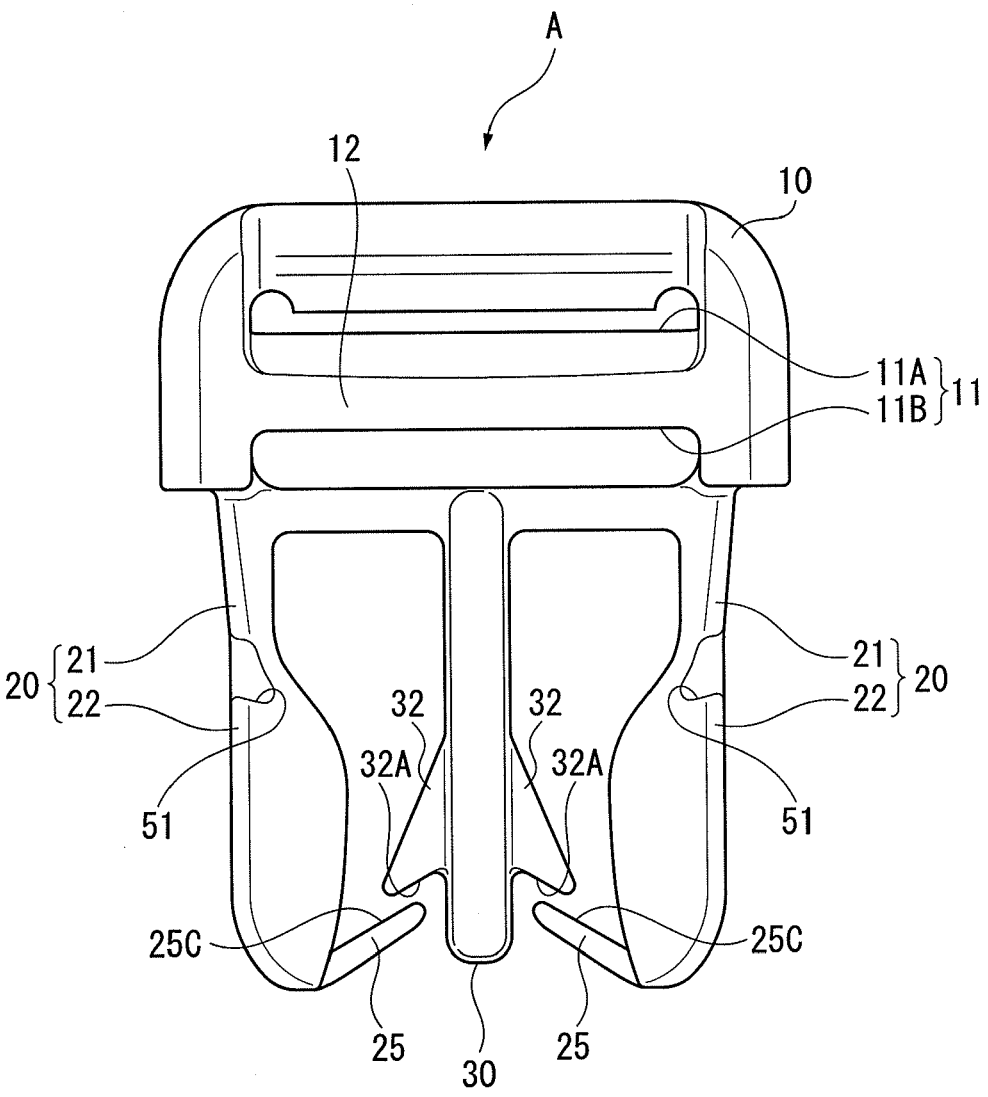
FIG. 11 is a plan view showing a male member of a buckle according to a fourth exemplary embodiment of the invention.

Further, the shape of the movement restricting portions 25 and the deformation restricting portions 32 is not limited to a hook shape but may alternatively be defined as projections as in a fourth exemplary embodiment shown in FIG. 11.

Fifth Exemplary Embodiment

Figure 12:
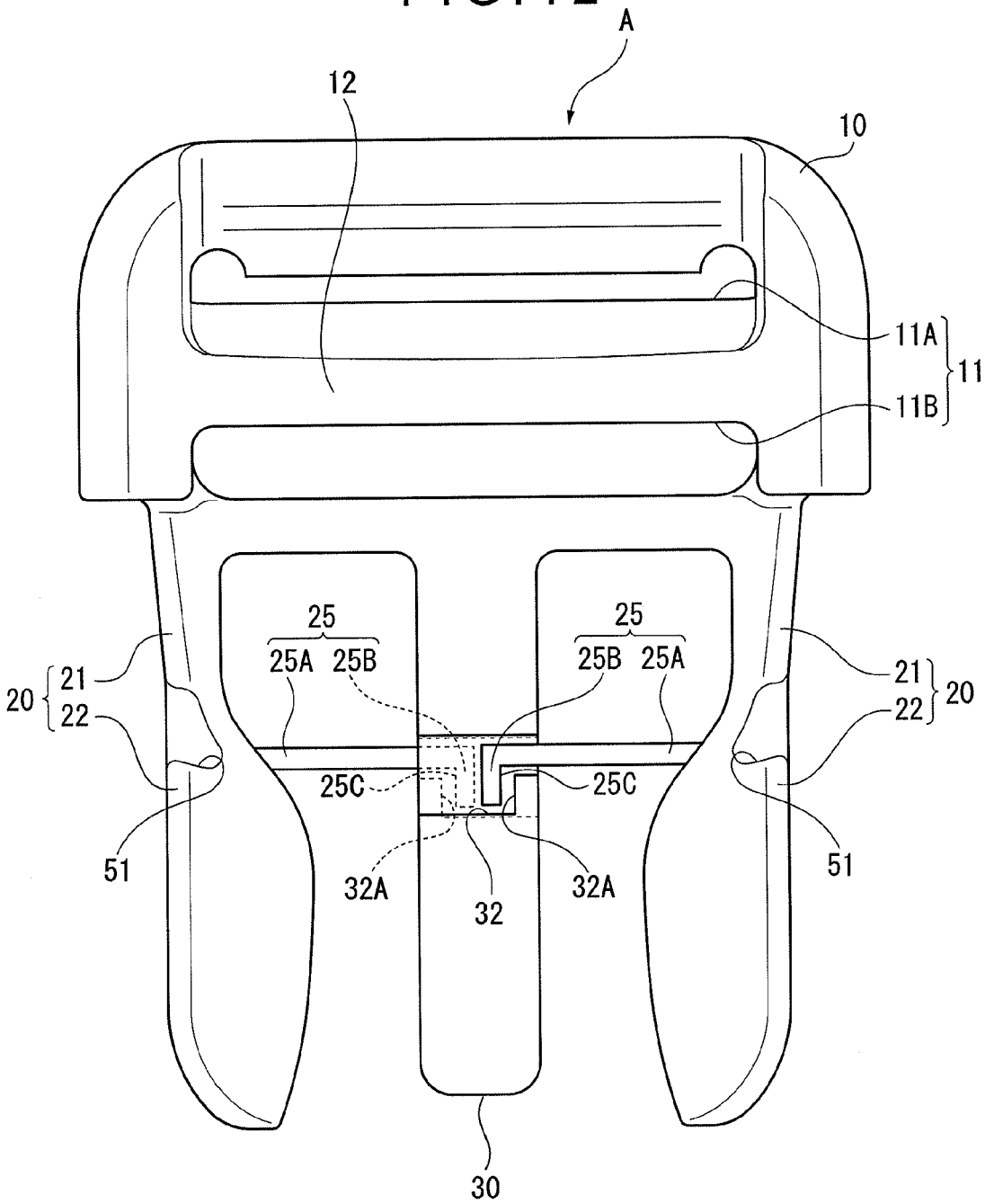
FIG. 12 is a plan view showing a male member of a buckle according to a fifth exemplary embodiment of the invention.
Figure 13:
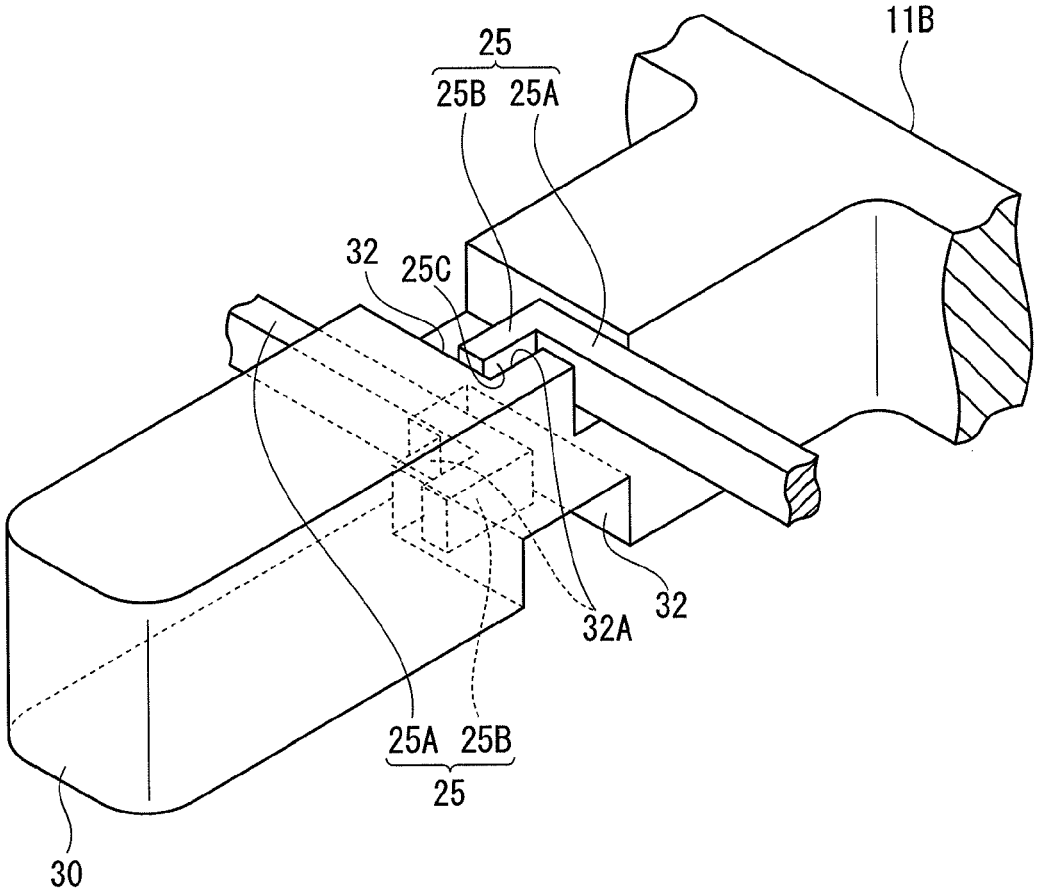
FIG. 13 is a partial perspective view showing a proximity of a guide of the male member according to the fifth exemplary embodiment.

Further, though the deformation restricting portions 32 in the second exemplary embodiment shown in FIGS. 7 to 9 are defined as projections, the deformation restricting portions 32 may alternatively be provided in a form of recesses as shown in a fifth exemplary embodiment shown in FIGS. 12 and 13 for achieving the same effect as long as the deformation restricting portion 32 includes the restricting surfaces 32A to be in contact with the movement restricting portions 25 when the legs 20 are outwardly deformed.

Sixth Exemplary Embodiment

Figure 14:
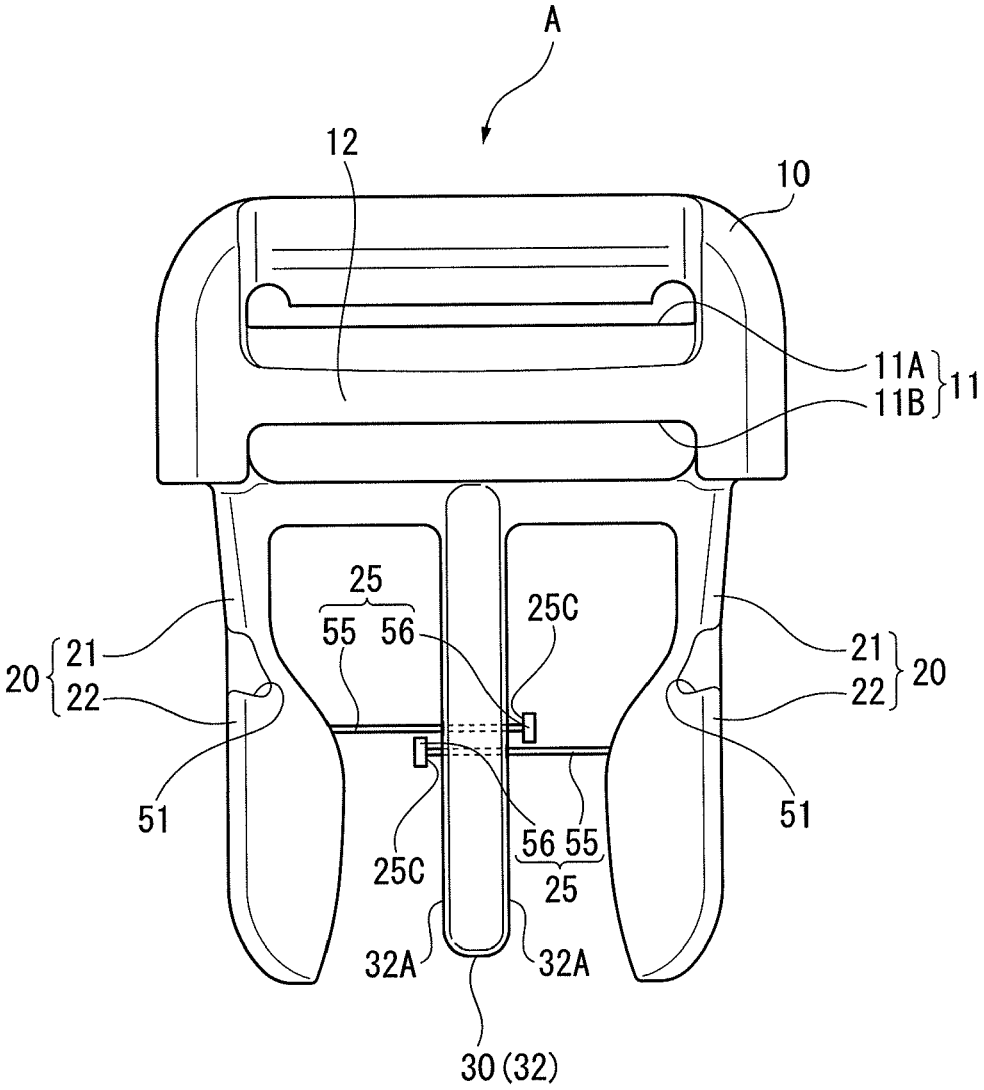
FIG. 14 is a plan view showing a male member of a buckle according to a sixth exemplary embodiment of the invention.

Further, though the movement restricting portions 25 are provided as a rigid member in the second exemplary embodiment shown in FIGS. 7 to 9, the movement restricting portions 25 may alternatively be provided as a flexible member as in a sixth exemplary embodiment shown in FIG. 14. Specifically, the movement restricting portions 25 may be provided by string members 55 integrally extending from each of the legs 20 and being penetrated into a through hole (not shown) provided in the guide 30. The string members 55 are provided with a large diameter portion 56 having the abutment surface 25C incapable of passing through the through hole. The deformation restricting portion 32 is provided by lateral faces (the restricting surfaces 32A) of the guide 30.

In the second exemplary embodiment shown in FIGS. 7 to 9, the abutment surfaces 25C are in contact with the restricting surfaces 32A in accordance with the distance between the legs 20 and the guide 30. Thus, even when the leg(s) 20 is deformed not only in width direction but also in the thickness direction or a diagonal direction, the abutment surfaces 25C is in contact with the restricting surfaces 32A, thereby preventing the damage on the leg(s) 20.

Seventh Exemplary Embodiment

Figure 15:
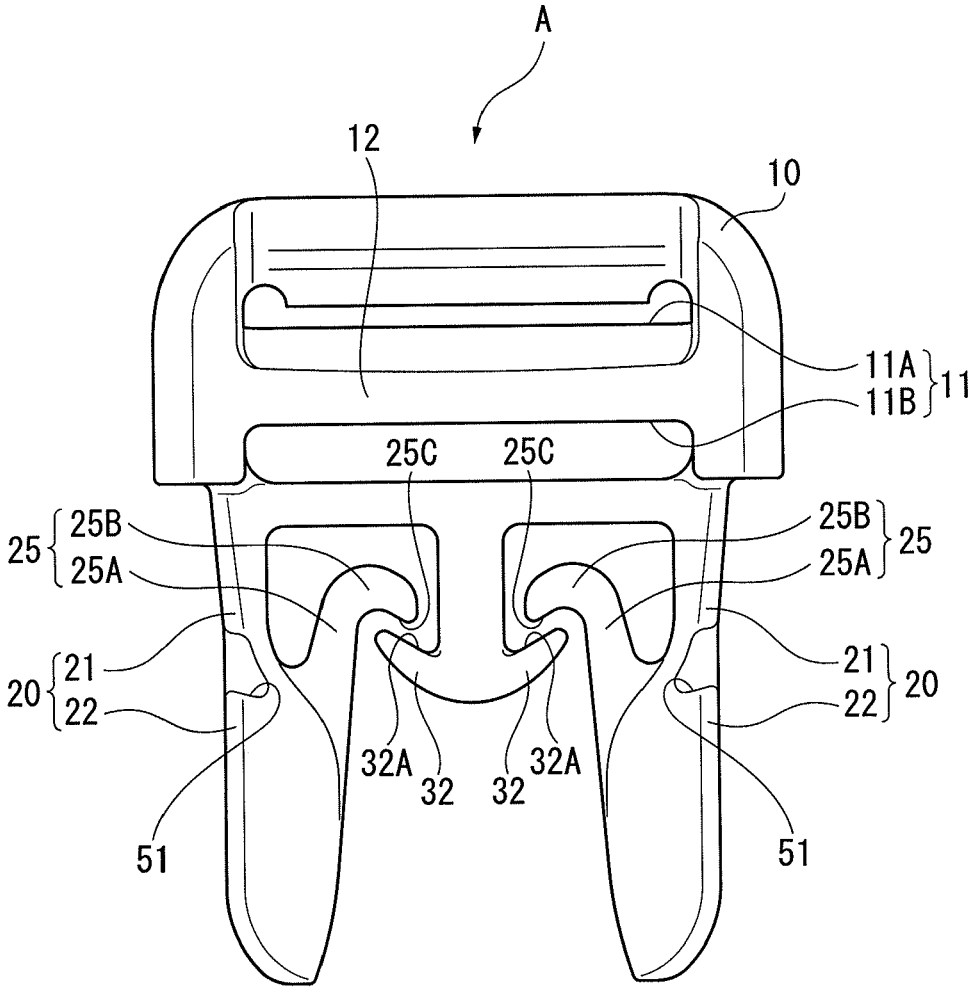
FIG. 15 is a plan view showing a male member of a buckle according to a seventh exemplary embodiment of the invention.

Though the deformation restricting portions 32 are provided to the guide 32 in the second exemplary embodiment shown in FIGS. 7 to 9, the deformation restricting portions 32 may be provided directly to the male base 10 instead of providing the guide 30 as in a seventh exemplary embodiment shown in FIG. 15.

Eighth Exemplary Embodiment

Figure 16:
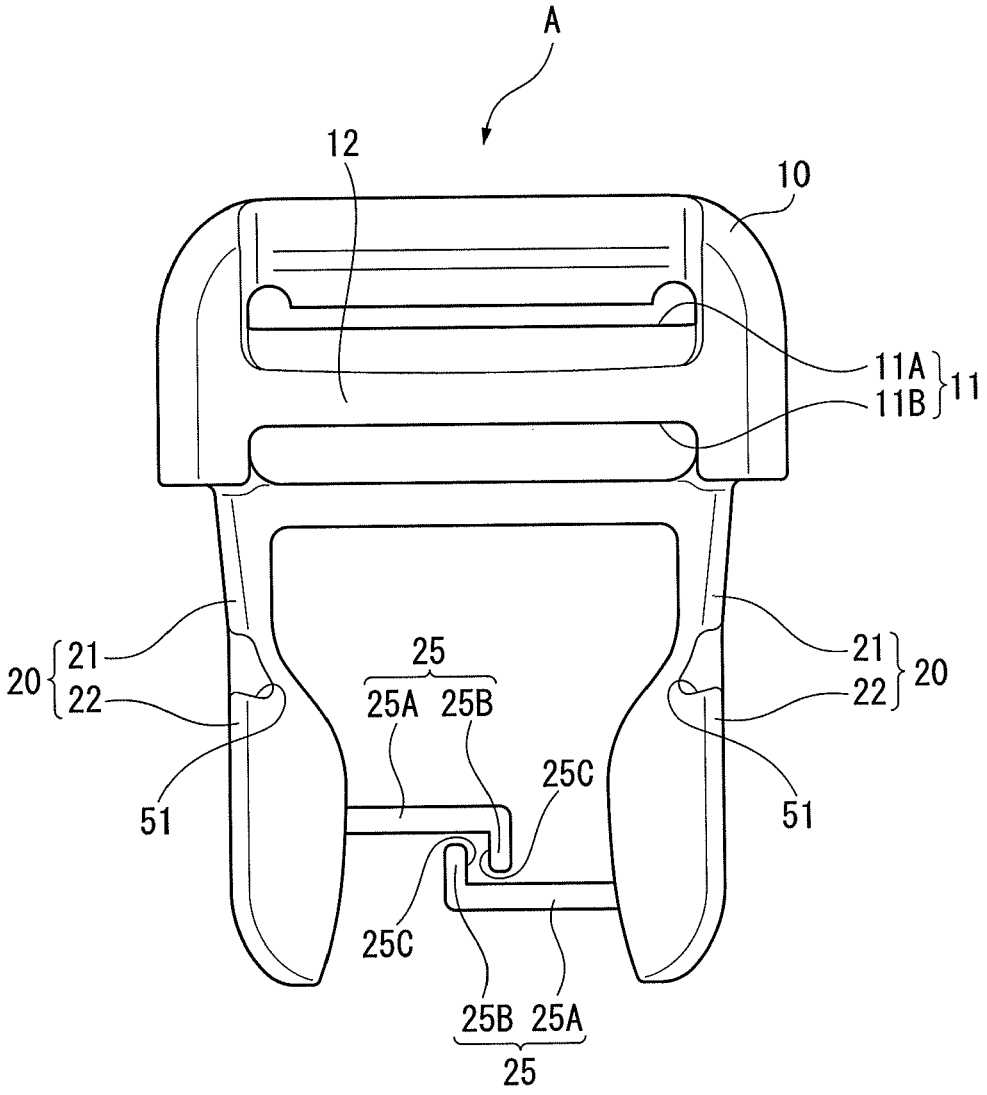
FIG. 16 is a plan view showing a male member of a buckle according to an eighth exemplary embodiment of the invention.

Further, though the deformation restricting portions 32 are provided in the second exemplary embodiment shown in FIGS. 7 to 9, the damage of the leg 20 when the leg(s) 20 is outwardly deformed may be prevented by bringing the movement restricting portion 25 of one of the legs 20 into contact with the movement restricting portion 25 of the other of the legs 20 as shown in an eighth exemplary embodiment shown in FIG. 16.

Though the above-described exemplary embodiments are directed to a buckle for connecting/separating string member(s) such as a belt, the male base and/or the female base may be integrally attached to a garment or a bag with a string member in a form of a thread sewn to a material of the garment or the bag.

Though the guide 30 in the above exemplary embodiment is engaged with the guide groove 47 (guide portion) in the form of the recessed groove, any mechanism capable of guiding the insertion operation may be used. For instance, a recessed groove may alternatively be provided on the guide 30 and a rib may be provided on the female member B as a guide for the recessed groove on the guide 30. It should be noted that, in an arrangement provided with the pair of legs 20, the mechanism for guiding the insertion operation is preferably provided between the legs 20 in terms of convenience for the manufacturing.

Specific arrangement and/or shape in implementing the invention may be modified in any manner as long as such a modification is compatible with the invention.

INDUSTRIAL APPLICABILITY

The invention is applicable to any buckle, especially for a buckle which is adapted to be operated with a light load, such as a buckle for connecting/separating a seat belt for a baby buggy.

The invention claimed is:

1. A buckle comprising: a male member; and a female member into which the male member is inserted for engagement, the male member comprising a male base to which a string member is attachable; a pair of legs projected from the male base, the pair of legs being capable of elastic deformation in a direction orthogonal to an insertion direction of the male member; and an engagement portion respectively provided on each of the legs to be detachably engaged with the female member, the female member comprising a female base to which a string member is attachable; an insertion hole provided in the female base into which the pair of legs are insertable while being elastically deformed in a direction for the legs to approach each other; a housing space provided in the female base in communication with the insertion hole, the pair of legs being housed within the housing space; and engaged portions with which the engagement portions are engaged in a manner capable of detachment due to a restoration force of the pair of legs against the elastic deformation when the pair of legs are inserted to a predetermined position, wherein the male member comprises a movement restricting portion provided on each of the legs, the movement restricting portions projecting in a direction towards each other; and deformation restricting portions provided on the male base, wherein the deformation restricting portions are spaced apart from the movement restricting portions when the male member is engaged with the female member, and one of the movement restricting portions is in contact with one of the deformation restricting portions to restrict the leg with the one of the movement restricting portions from deforming in a direction opposite to the direction for the legs to approach each other when the leg with the one of the movement restricting portions is deformed in the direction opposite to the direction for the legs to approach each other, wherein each of the movement restricting portions includes an abutment surface, and each of the deformation restricting portions includes a restricting surface facing one of the abutment surfaces, the restricting surface of the one of the deformation restricting portions being in contact with the abutment surface of the one of the movement restricting portions when the leg with the one of the movement restricting portions is deformed in a direction opposite to the direction for the pair of legs to approach each other.

2. The buckle according to claim 1, wherein the deformation restricting portions are directly provided to the male base.

3. The buckle according to claim 1, wherein the male member comprises a guide provided on the male base and projected from between the pair of legs, the female member comprises a guide portion with which the guide inserted through the insertion hole is in slidable contact to guide an insertion of the male member, and the deformation restricting portion is provided on the guide.

4. The buckle according to claim 1, wherein the movement restricting portions are provided in an area of each of the legs between a center of a projection length and a base end of each of the legs near the male base.

5. The buckle according to claim 1, wherein the engagement portions are provided on an outer surface of each of the legs opposite to a side where the pair of legs face each other.

6. The buckle according to claim 1, wherein the engagement portions are provided on an end of each of the legs and bulge to define projections in a direction orthogonal to the direction for the legs to approach each other and orthogonal to the insertion direction, and the engaged portions are provided in recessed grooves extending along a width direction.

7. A buckle comprising: a male member; and a female member into which the male member is inserted for engagement, the male member comprising a male base to which a string member is attachable; a pair of legs projected from the male base, the pair of legs being capable of elastic deformation in a direction orthogonal to an insertion direction of the male member; and an engagement portion provided on each of the legs to be detachably engaged with the female member, the female member comprising a female base to which a string member is attachable; an insertion hole provided in the female base into which the pair of legs are insertable while being elastically deformed in a direction for the legs to approach each other; a housing space provided in the female base in communication with the insertion hole, the pair of legs being housed within the housing space; and engaged portions with which the engagement portions are engaged in a manner capable of detachment due to a restoration force of the pair of legs against the elastic deformation when the pair of legs are inserted to a predetermined position, wherein the male member comprises movement restricting portions provided on the legs, the movement restricting portions projecting in a direction towards each other and being in contact with each other to restrict the legs from deforming in a direction opposite to the direction for the legs to approach each other when one or both of the legs is deformed in the direction opposite to the direction for the legs to face with each other, wherein each of the movement restricting portions includes an abutment surface facing the leg from which the movement restricting portion projects, the abutment surfaces face each other and are adapted to be in contact with each other when one or both of the legs is deformed in the direction opposite to the direction for the legs to approach each other.

8. The buckle according to claim 7, wherein the engagement portions are provided on an outer surface of each of the legs opposite to a side where the pair of legs face each other.

9. The buckle according to claim 7, wherein the engagement portions are provided on an end of each of the legs and bulge to define projections in a direction orthogonal to the direction for the legs to approach each other and orthogonal to the insertion direction, and the engaged portions are provided in recessed grooves extending along a width direction.

* * * * *

UNITED STATES PATENT AND TRADEMARK OFFICE

CERTIFICATE OF CORRECTION

PATENT NO. : 9,113,680 B2
APPLICATION NO. : 13/885012
DATED : August 25, 2015
INVENTOR(S) : Ryoichiro Takazakura It is certified that error appears in the above-identified patent and that said Letters Patent is hereby corrected as shown below:

On the Title page, in item (57), in column 2, under "Abstract", line 8, before "provided" insert -- is --.

IN THE SPECIFICATION

In column 1, line 3, below "BUCKLE" delete "TECHNICAL FIELD".

In column 1, line 7, above "The present invention relates to a buckle having a male" insert -- TECHNICAL FIELD --.

Signed and Sealed this
Twenty-sixth Day of January, 2016

Michelle K. Lee

Michelle K. Lee
*Director of the United States Patent and Trademark Office*